US009364378B2

(12) United States Patent
Mael et al.

(10) Patent No.: US 9,364,378 B2
(45) Date of Patent: Jun. 14, 2016

(54) WHEELCHAIR INCLUDING A COLLAPSIBLE AND/OR ANGLE ADJUSTABLE BACKREST FRAME

(75) Inventors: Robert Mael, Tours (FR); Jean-Michel Roncin, Tours (FR)

(73) Assignee: INVACARE INTERNATIONAL SARL, Gland (CH)

( * ) Notice: Subject to any disclaimer, the term of this patent is extended or adjusted under 35 U.S.C. 154(b) by 0 days.

(21) Appl. No.: 14/418,090

(22) PCT Filed: Jul. 31, 2012

(86) PCT No.: PCT/IB2012/053911
§ 371 (c)(1),
(2), (4) Date: Apr. 15, 2015

(87) PCT Pub. No.: WO2014/020378
PCT Pub. Date: Feb. 6, 2014

(65) Prior Publication Data

US 2015/0231003 A1 Aug. 20, 2015

(51) Int. Cl.
*A61G 5/10* (2006.01)
*A61G 5/08* (2006.01)

(52) U.S. Cl.
CPC ..... *A61G 5/1067* (2013.01); *A61G 5/08* (2013.01)

(58) Field of Classification Search
CPC ..... A61G 5/08; A61G 5/1067
USPC ..... 297/362.14, 378.12
See application file for complete search history.

(56) References Cited

U.S. PATENT DOCUMENTS 1,527,754 A * 2/1925 Simon ..... A61G 5/1059 297/284.1
2,339,361 A * 1/1944 Sill ..... A61G 5/1067 297/327

(Continued)

FOREIGN PATENT DOCUMENTS

EP 0384499 A1 8/1990

OTHER PUBLICATIONS

Written Opinion and International Search Report from PCT Application No. PCT/IB12/53911 dated Apr. 26, 2013.

(Continued)

*Primary Examiner* — Peter Brown
(74) *Attorney, Agent, or Firm* — Calfee, Halter & Griswold LLP

(57) ABSTRACT

The present invention relates to a wheelchair (10) comprising a wheelchair frame (1) resting on wheels (2, 3) and supporting a seat (4), and a backrest frame (5) supporting a backrest (6), said backrest frame (5) being pivotally connected to said wheelchair frame (1) and comprising two lateral tubular elements (5*a*), wherein each tubular element (5*a*) comprises an upper end portion (5*b*) provided with a handle (5*d*) and a lower end portion (5*c*) pivotally mounted on an axis (7) supported on a support (11) fixedly connected to the wheelchair frame (1), characterized in that locking/unlocking means (12) are provided for preventing the lower end portion (5*c*) of at least one of said tubular elements (5*a*), and preferably of each one of said tubular elements, to pivot relative to the corresponding support (11) in a locked inclined position of the backrest frame (5), said locking/unlocking means (12) being configured so as to permit a stepless adjustment of the angle (α0) between a plane (P1) defined by the backrest (6) and a plane (P2) defined by the seat (4) in said locked inclined position.

18 Claims, 10 Drawing Sheets

(56) References Cited

U.S. PATENT DOCUMENTS 3,774,964 A * 11/1973 Turner ..... B60N 2/233 297/361.1
5,364,165 A * 11/1994 Okamoto ..... A61G 5/10 280/304.1
5,597,205 A * 1/1997 Glance ..... B60N 2/233 297/216.1
6,126,186 A * 10/2000 Mascari ..... A61G 5/12 280/220
6,913,318 B2 * 7/2005 Higley ..... A61G 5/1067 297/383
7,192,042 B2 * 3/2007 Cerreto ..... A61G 5/00 280/250.1
2005/0029855 A1 2/2005 Hanson
2005/0236813 A1 * 10/2005 Cerreto ..... A61G 5/08 280/647
2006/0076814 A1 * 4/2006 Samila ..... A61G 5/1067 297/354.12

OTHER PUBLICATIONS

International Preliminary Report on Patentability from PCT Application No. PCT/IB12/53911 dated Feb. 3, 2015.

* cited by examiner

WHEELCHAIR INCLUDING A COLLAPSIBLE AND/OR ANGLE ADJUSTABLE BACKREST FRAME

RELATED APPLICATIONS

The present application is the U.S. national phase entry of PCT/IB2012/053911, filed on Jul. 31, 2012, the entire disclosure of which is fully incorporated herein by reference.

TECHNICAL FIELD

The present invention relates in general to a wheelchair including a collapsible and/or angle adjustable backrest frame.

PRIOR ART AND THE PROBLEM UNDERLYING THE INVENTION

Foldable wheelchairs have been known for some time, and the advantages are numerous with respect to managing the wheelchair when it is not in use, or for transportation of the wheelchair.

In general, foldable wheelchairs include collapsible backrest frames which can be pivotally folded down from a generally vertical position to a generally horizontal position parallel to and atop the seat. This operation provides partial collapsibility of the wheelchair which reduces the overall dimensions. The backrest frame can advantageously be locked in its operating vertical position via locking/unlocking means.

Occasionally, such foldable wheelchairs may also comprise angle adjustable backrest frame. Thus, the backrest frame can be locked in an operating inclined position wherein the angle of the plane defined by the backrest is slightly inclined relative to the vertical.

However, the problem with such foldable wheelchairs provided with a collapsible and angle adjustable backrest frame is often the necessity for the user to use specific tools for actuating the locking/unlocking means when he wants to move the backrest frame from its operating inclined position to its fully folded position in which the wheelchair can be easily transported and to dismantle and reassembly several components of the backrest frame when he wants to modify the inclination of the backrest in its operating inclined position.

Thus, a first objective of the present invention is to provide a wheelchair in which the backrest can be folded and/or adjusted without requiring any specific tools to actuate the locking/unlocking means and any dismantling of certain parts of the backrest frame.

A second objective of the present invention is to provide a wheelchair including a backrest frame that can be easily and quickly folded and/or angle adjusted.

A third objective of the present invention is to provide a wheelchair including a backrest frame that can be stepless angle adjusted.

A fourth objective of the present invention is to provide a wheelchair including a backrest frame that can be locked in an inclined position in which the backrest frame is prevented to pivot relative to the wheelchair frame.

A fifth objective of the present invention is to provide a wheelchair including a backrest frame that can be locked both in a folded position and in an erected position.

SUMMARY OF INVENTION

In an aspect, the present invention provides a wheelchair comprising a wheelchair frame resting on wheels and supporting a seat, and a backrest frame supporting a backrest, said backrest frame being pivotally connected to said wheelchair frame and comprising two lateral tubular elements, wherein each tubular element comprises an upper end portion provided with a handle and a lower end portion pivotally mounted on an axis supported on a support fixedly connected to the wheelchair frame, characterized in that locking/unlocking means are provided for preventing the lower end portion of each one of said tubular elements to pivot relative to the corresponding support in a locked inclined position of the backrest frame, said locking/unlocking means being configured so as to permit a stepless adjustment of the angle between a plane defined by the backrest and a plane defined by the seat in said locked inclined position.

Further aspects and preferred embodiments are provided in the appended claims.

BRIEF DESCRIPTION OF THE DRAWINGS

The wheelchair of the present invention will be described in further detail further below, when useful with reference to the attached drawings, which show an exemplary wheelchair frame according to the invention.

DETAILED DESCRIPTION OF THE PREFERRED EMBODIMENTS

For the purpose of the present specification, situations and directions of elements of the wheelchair of the present invention are determined by the perspective of a user seated in the wheelchair. Accordingly, the rear side of the wheelchair corresponds to the left side of FIG. 1. The situations or directions "up" or "top" and "down" or "bottom", "rear" or "back" and "front", "behind" and "in front", "upper" and "lower", "lateral" and "central" follow the same rule. A longitudinal direction corresponds to a back-to-front direction and a lateral direction corresponds to a left-to-right direction. The horizontal corresponds to the plane tangential to the rear and front wheels and positioned under said wheels when the wheelchair is its normal position of use. A horizontal plane corresponds to a plane parallel to the horizontal. The vertical, or a vertical plane, corresponds to a plane perpendicular to the horizontal.

Figure 1:
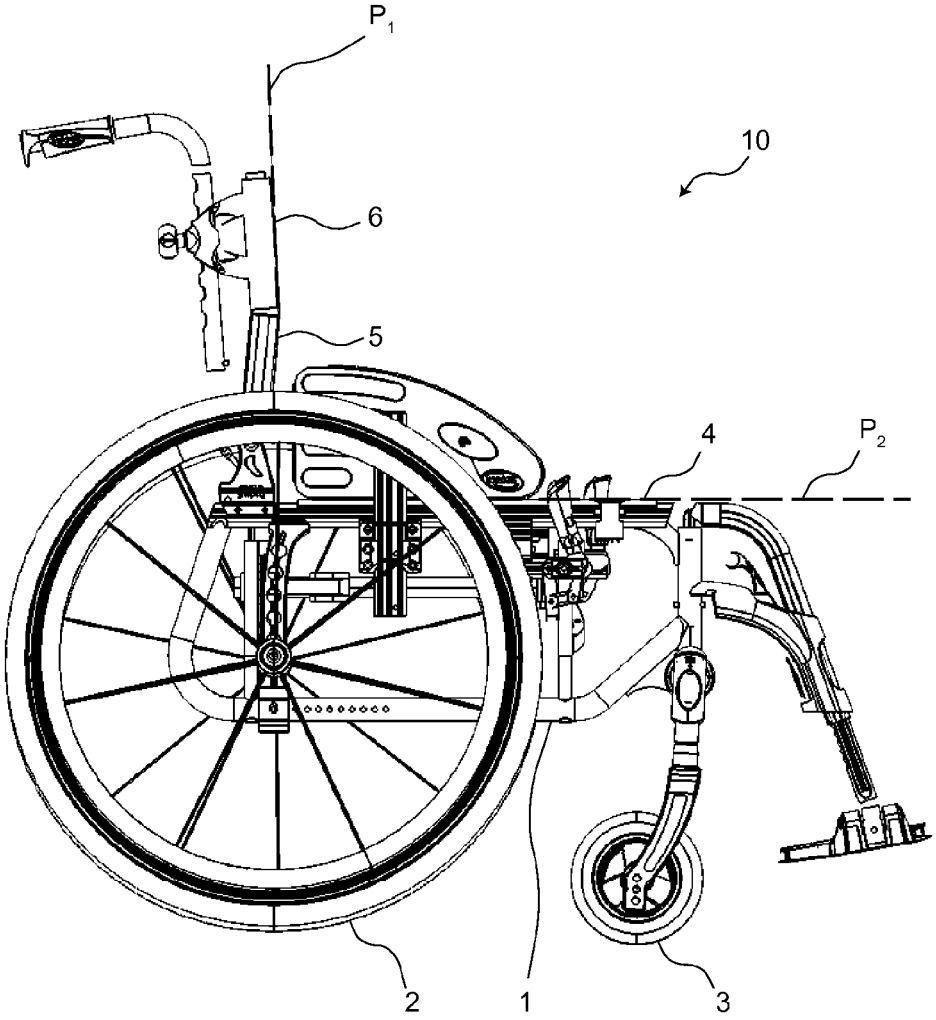
FIG. 1 is a side view of a wheelchair according to the present invention, said wheelchair being in its position of use.

FIG. 1 shows a wheelchair according to the present invention. The wheelchair 10 of FIG. 1 includes a frame 1 with rear and front wheels 2 and 3, respectively, extending downwardly therefrom for engaging the ground. The frame 1 includes a left side component and a right side component connected together via lateral struts, the left side component and the right side component being substantially identical. Therefore, to simplify our explanations, we will only describe in the following paragraphs the left side component. The wheelchair frame 1 supports a seat 4 and a backrest frame 5 supporting a backrest 6. The backrest frame 5 comprises two lateral tubular elements, respectively left and right lateral tubular elements, connected at their lower end to the wheelchair frame 1. In the erected position of the backrest frame illustrated in FIG. 1, the backrest 6 defines a plane P1 and the seat 4 defines a plane P2, said plane P1 being substantially perpendicular to said plane P2. As explained in greater detail in the following description, the wheelchair 10 of the present invention is configured so that the angle between said plane P1 and said plane P2 may be stepless adjusted.

Figure 2A:
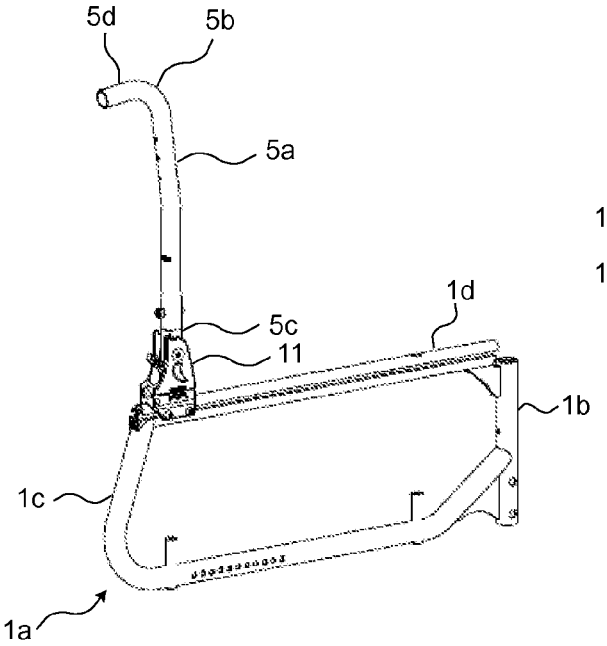
FIG. 2*a* is a perspective view of one of the tubular elements of the backrest frame of the wheelchair of FIG. 1 when connected to its corresponding support, the backrest frame being in its locked inclined position.
Figure 2B:
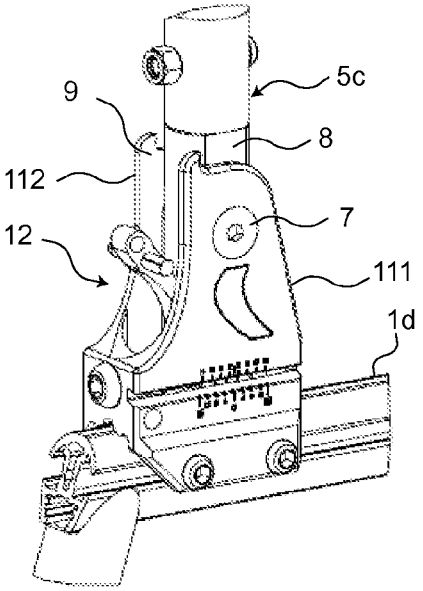
FIG. 2*b* is a view similar to FIG. 2*a*, but on an enlarged scale.
Figure 2C:
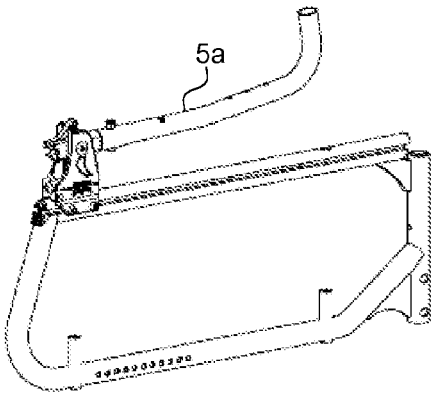
FIG. 2*c* is a view similar to FIG. 2*a*, but the backrest frame being in its locked folded position.
Figure 3A:
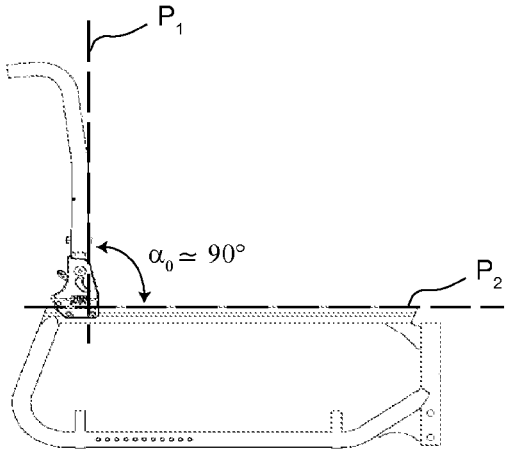
FIG. 3*a* is the side view corresponding to the perspective view of FIG. 2*a*.
Figure 3B:
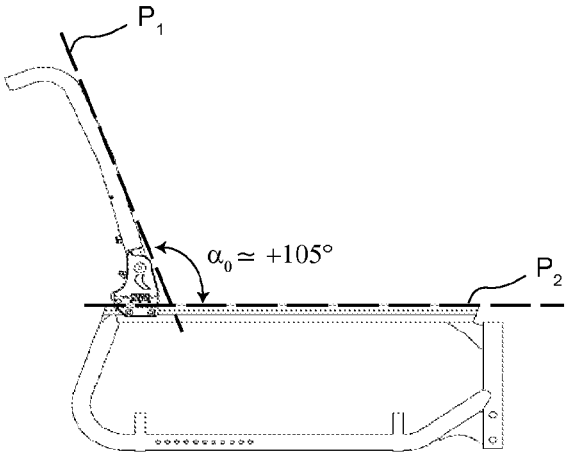
FIG. 3*b* is a view similar to FIG. 3*a*, but with a different inclination of the backrest relative to the seat.
Figure 3C:
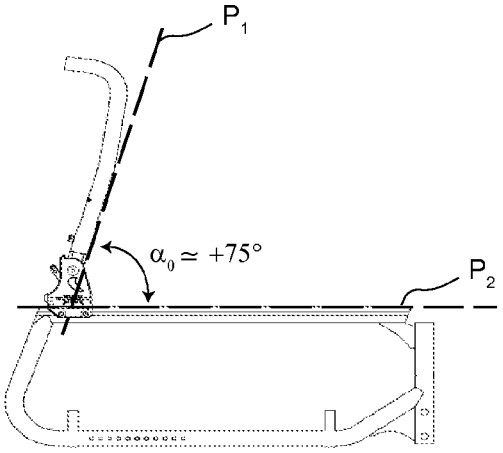
FIG. 3*c* is a view similar to FIG. 3*a*, but with a different inclination of the backrest relative to the seat.
Figure 4A:
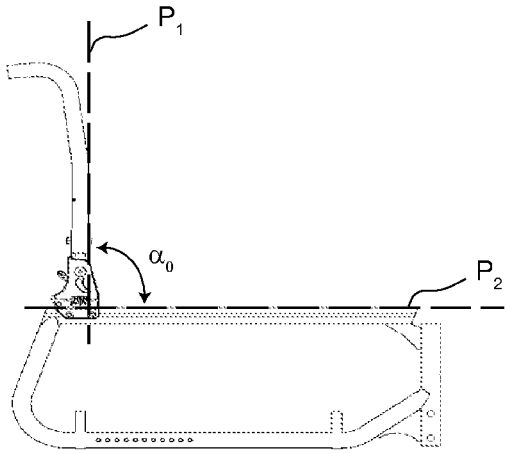
FIG. 4*a* is the side view corresponding to the perspective view of FIG. 2*a*.
Figure 4B:
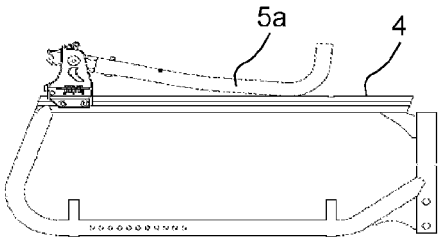
FIG. 4*b* is a view similar to FIG. 4*a*, but the backrest frame being in its released position and the backrest abutting against the seat.
Figure 4C:
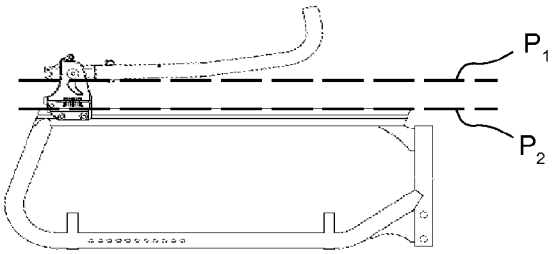
FIG. 4*c* is a view similar to FIG. 4*a*, but the backrest frame being its locked folded position.

With reference to FIG. 2*a*, the left side component 1*a* of the wheelchair frame 1 comprises an upright 1*b*, an L-shaped bar 1*c* and a horizontal profile 1*d* extending therebetween. The profile 1*d* may advantageously be configured as a rail along which may be fixedly connected a support 11 to which is connected the lower portion 5*c* of the left lateral tubular element 5*a* of the backrest frame 5, said tubular element comprising an upper portion 5*b* provided with a handle 5*d*. As shown in detail in FIG. 2*b*, the support 11 comprises a left part 111 and a right part 112 integral therewith, said left part and said right part being laterally spaced-apart so that the lower portion 5*c* of the tubular element 5*a* can be at least partially positioned inside the free space separating said left and right parts 111 and 112. Said lower portion 5*c* may advantageously comprise two parallel flat surfaces 8 on its left and right sides, said flat surfaces 8 being parallel and slightly spaced-apart from the internally oriented surfaces 9 of the left and right parts 111 and 112. The lower portion 5*c* of the tubular element 5*a* is pivotally mounted on an axis 7 laterally extending between the left and right parts 111 and 112 of the support 11. As explained in greater detail in the following description, locking/unlocking means 12 are provided in the support 11 and at the lower end of the tubular element 5*a* so as to permit a stepless adjustment of the angle $\alpha_0$ between the plane P1 and the plane P2 in the erected position of the backrest frame 5 illustrated in FIG. 1. In particular, the angle $\alpha_0$ may be adjusted via said locking/unlocking means 12 so as to be substantially equal to 90°, as illustrated in FIG. 3*a*, to 105°, as illustrated in FIG. 3*b*, or to 75°, as illustrated in FIG. 3*c*. Therefore, any angle $\alpha_0$ between 75° and 105° can be adjusted through said locking/unlocking means 12. Of course, said locking/unlocking means 12 may be configured so as to enlarge or reduce this angular range. Furthermore, as explained in greater detail in the following description, said locking/unlocking means 12 may also be configured so as to unlock the backrest frame 5 from its locked inclined position as illustrated in FIG. 4*a*, thus permitting the positioning of said backrest frame 5 into a completely folded position as illustrated in FIG. 4*b*, in which the tubular element 5*a* or the backrest 6 abuts against the seat 4. Said locking/unlocking means 12 may also be configured so as to lock the backrest frame 5 into a locked folded position as illustrated in FIGS. 2*c* and 4*c*, in which the plane P1 is substantially parallel to the plane P2.

Figure 5C:
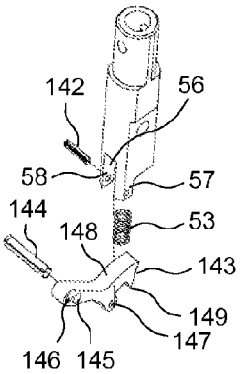
FIG. 5*c* is a perspective exploded view of the lower end portion of the tubular element shown in FIG. 5*a*.
Figure 5A:
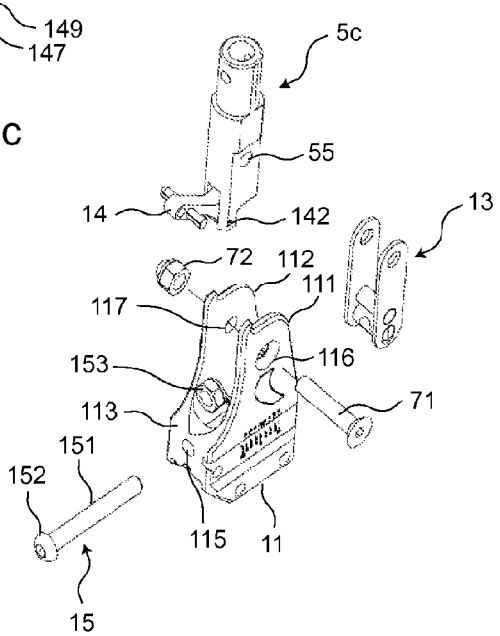
FIG. 5*a* is a perspective partially exploded view of a first embodiment of locking/unlocking means used in the wheelchair of FIG. 1 to lock one tubular element of the backrest frame to the corresponding support of the wheelchair frame.
Figures 7A, 7B:
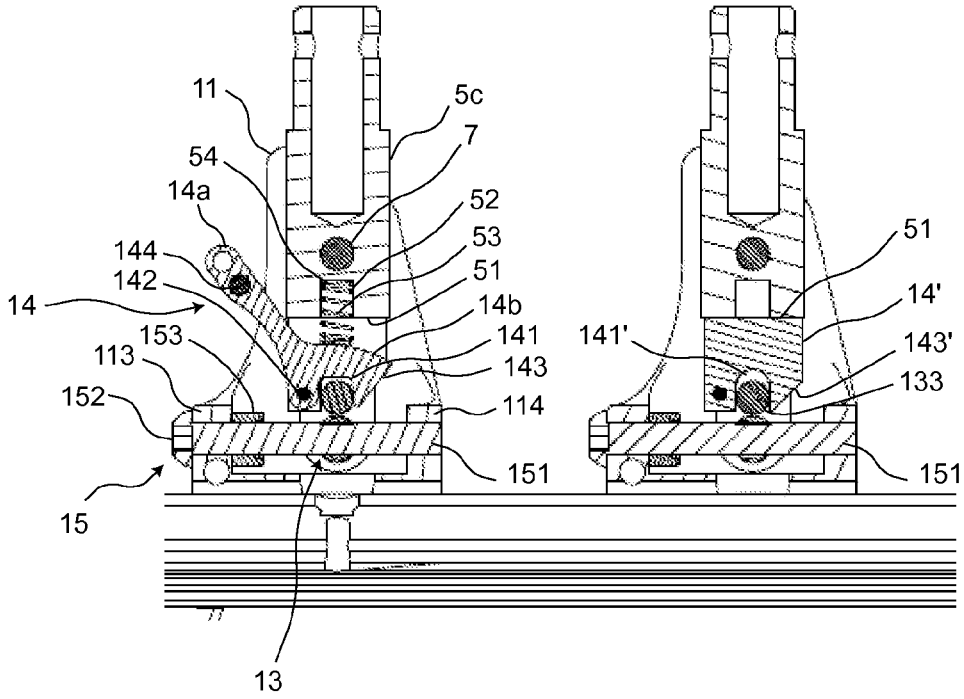
FIG. 7*a* is a sectional view on an enlarged scale of the lower end portion of one tubular element and of the corresponding support as shown in FIG. 2*a*.
FIG. 7*b* is a view similar to FIG. 7*a*, apart that the pivoting locking/unlocking element has been replaced by a fixed locking/unlocking element.

A first embodiment of the locking/unlocking means 12 is shown in FIGS. 5*a* and 7*a*. This locking means 12 comprises one abutment element 13 connected to the support 11 and one locking/unlocking element 14 pivotally connected to the lower end portion 5*c* of a tubular element 5*a*.

Figure 5B:
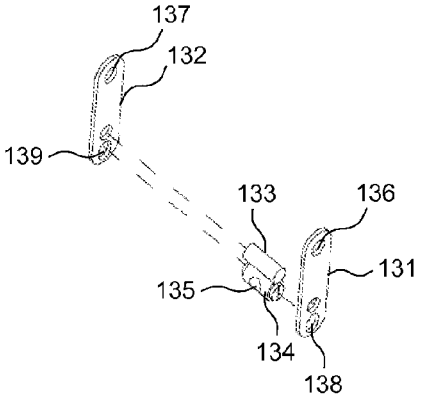
FIG. 5*b* is a perspective exploded view of the abutment element shown in FIG. 5*a*.

As shown in FIG. 5*b*, the abutment element 13 comprises an upper part 133 and a lower part 134, said upper and lower parts having a substantially cylindrical form and extending in a lateral direction. The left, respectively the right, end of said upper part 133 is fixedly connected to a left plate 131, respectively a right plate 132, extending in a vertical direction and the left, respectively the right, end of said lower part 134 is rotatably connected to said left plate 131, respectively said right plate 132. Furthermore, said left, respectively said right, end of said lower part 134 is slidably received in an oblong through-hole 138, respectively 139, of said left plate 131, respectively said right plate 132, so that the distance between the lower part 134 and the pivot axis 7 may vary according to the angle $\alpha_0$, thus permitting the longitudinal movement of the abutment element 13 along the threaded rod 151. The upper end of said left plate 131, respectively of said right plate 132, is pivotally connected to the left part 111, respectively the right part 112, of the support 11 via a screw 71 and a nut 72, said screw being received inside corresponding through-holes 136 of the left plate 131, respectively 137 of the right plate 132, and 116 of the left part 111, respectively 117 of the right part 112. Advantageously, said screw 71 is also received inside a through-hole 55 provided in the lower end portion 5*c* of the tubular element 5*a*, thus defining the pivot axis 7 between the tubular element 5*a* and the support 11. The lower part 134 is provided with a longitudinal threaded through-hole 135 adapted to receive a threaded rod 151 fixedly connected to the support 11. Thus, as explained in greater detail in the following description, the abutment element 13 may be stepless movable in a longitudinal direction relative to the support 11 under the action of said threaded rod 151. During the displacement of the abutment element 13 along the threaded rod 151, the inclination of the left and right plates 131, 132 and, thus, of the upper and lower parts 111, 112 of the abutment element 13, is progressively modified due to the fact that said left and right plates 131, 132 pivot relative to the axis 7.

Figure 6:
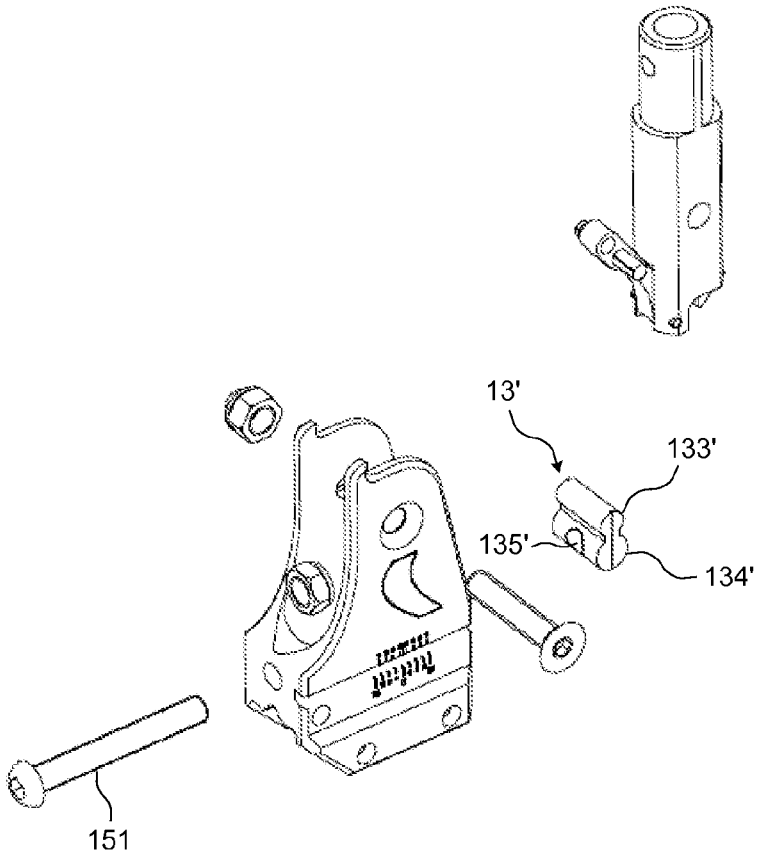
FIG. 6 is a perspective partially exploded view of a second embodiment of locking/unlocking means used in the wheelchair of FIG. 1 to lock one tubular element of the backrest frame to the corresponding support of the wheelchair frame.

In a second embodiment of the locking/unlocking means 12, illustrated in FIG. 6, the abutment element 13' comprises an upper part 133' and a lower part 134', said parts being integral into one single piece and said lower part 134' being provided with a longitudinal threaded through-hole 135' adapted to receive a threaded rod 151 fixedly connected to the support 11. Thus, in this embodiment, the inclination of the upper and lower parts 133', 134' is not modified during the displacement of the abutment element 13' along the threaded rod 151.

Figure 8A:
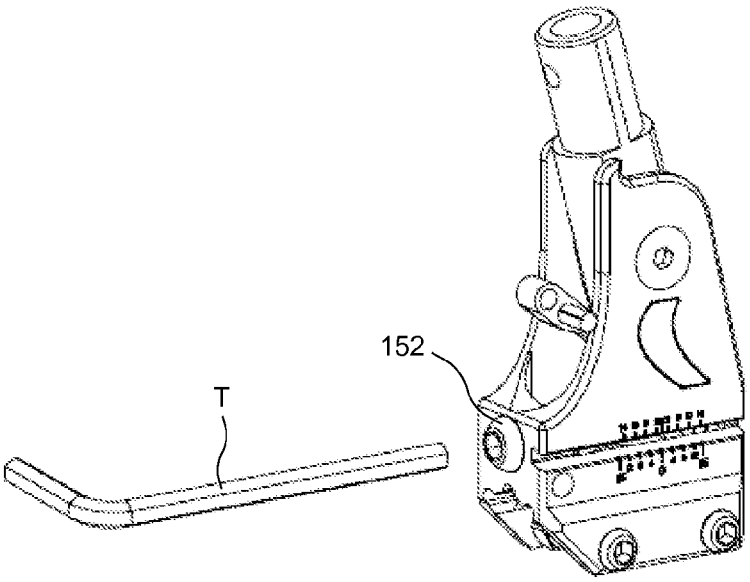
FIG. 8*a* is a perspective view on an enlarged scale of the lower end portion of one tubular element and of the corresponding support as shown in FIG. 2*a*, in a first embodiment of the driving means used for moving the abutment element.

In the embodiments shown in FIGS. 5*a*, 6 and 7*a*, the threaded rod 151 is defined by the shank of a screw 15 which is received inside corresponding threaded through-holes 115 provided in the central rear and front portions 113 and 114 of the support 11, which link the left part 111 to the right part 112. Said screw 15 is advantageously secured on the support 11 through a Nylstop® type nut 153 abutting against an internally oriented surface of the central rear portion 113. Said Nylstop® type nut 153 prohibits any loosening of the screw 15 when the user screws or unscrews said screw 15 so as to adjust the position of the abutment element 13 along a longitudinal direction. As shown in FIG. 8*a*, this operation can be done via a tool T, such as a screwdriver, a cruciform key or an Allen key, adapted to the head 152 of the screw 15.

Figure 8B:
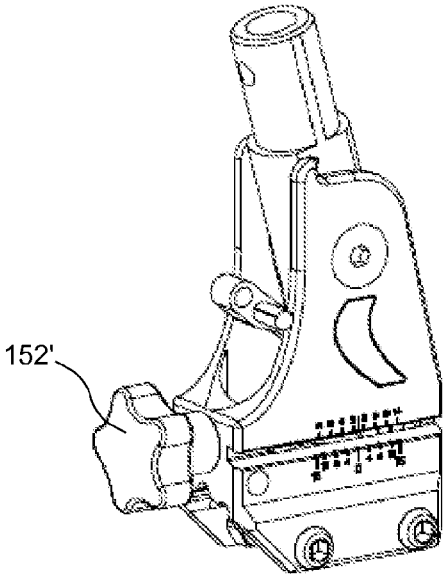
FIG. 8*b* is a view similar to FIG. 8*a*, but in a second embodiment of the driving means used for moving the abutment element.

In a further embodiment shown in FIG. 8*b*, the threaded rod 151 may also be fixedly connected at its rear end to a knob 152', said knob being configured so as to permit the user to screw or unscrew the threaded rod 151 by hand and without using a tool.

Figure 9:
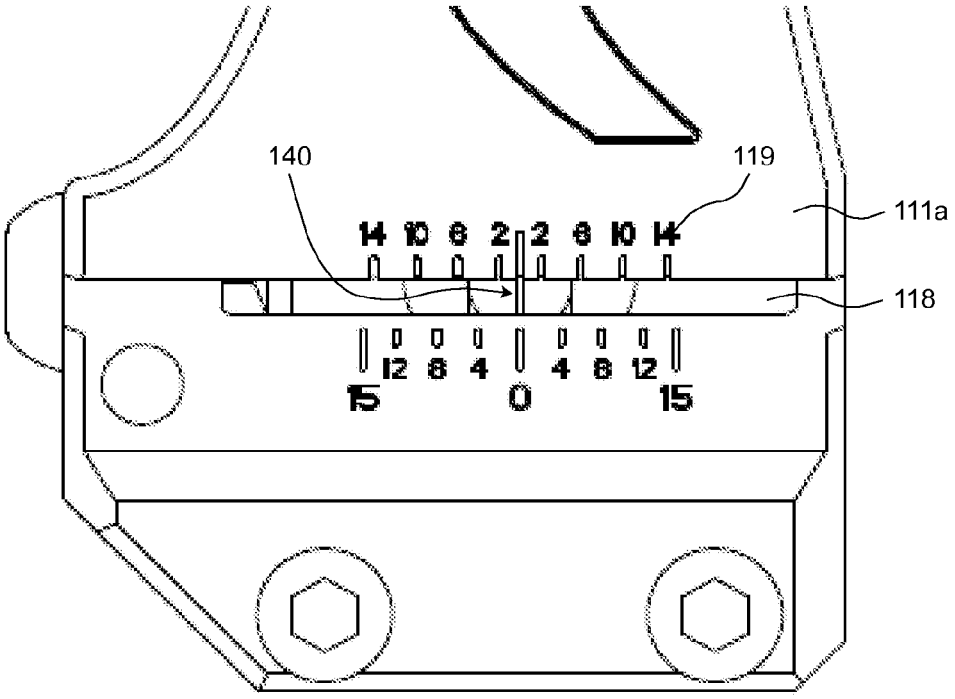
FIG. 9 is a side view on an enlarged scale of the support shown in FIG. 2*a*.

As shown in FIG. 9, the left part 111 of the support 11 may advantageously be provided with a longitudinal slot 118, said slot being aligned with the threaded rod 151 so that the position of the abutment element 13 or 13' relative to said threaded rod 151 can be seen by the user. Furthermore, the left oriented face 111*a* of said left part 111 may advantageously be provided with a scale 119 and the lower part 134, respectively 134', of said abutment element 13, respectively 13', may advantageously comprise a reference mark 140 on its left side face, said reference mark 140 indicating the position of the abutment element 13 or 13' along the threaded rod 151. Thus, by reading the graduation of the scale 119 which is aligned with the reference mark 140 of the abutment element 13 or 13', one can evaluate the angle between the plane P1 defined by the backrest 6 and the plane P2 defined by the seat 4.

Figure 2D:
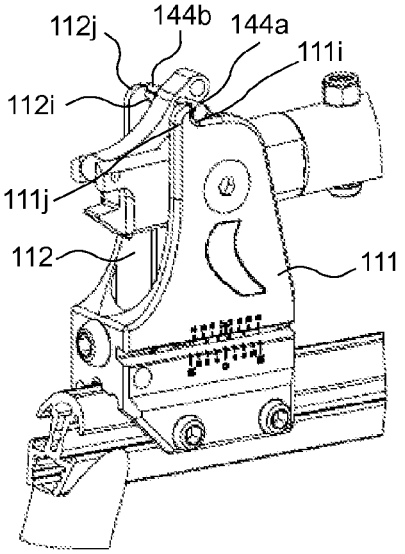
FIG. 2*d* is a view similar to FIG. 2*c*, but on an enlarged scale.
Figure 10A:
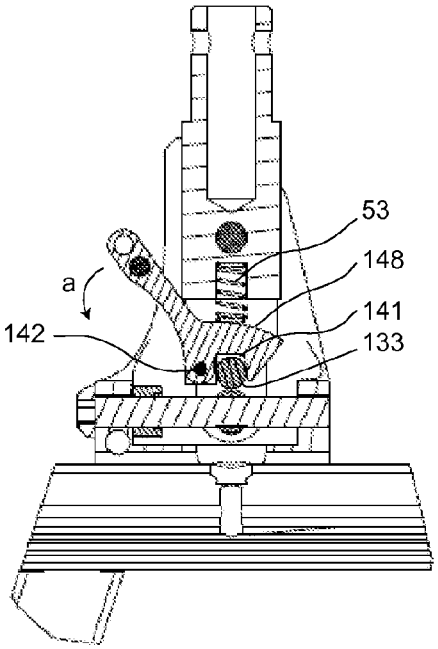
FIG. 10*a* is a sectional view on an enlarged scale of the lower end portion of one tubular element and of the corresponding support as shown in FIG. 2*a*, in the locked inclined position of the backrest frame.
Figure 10B:
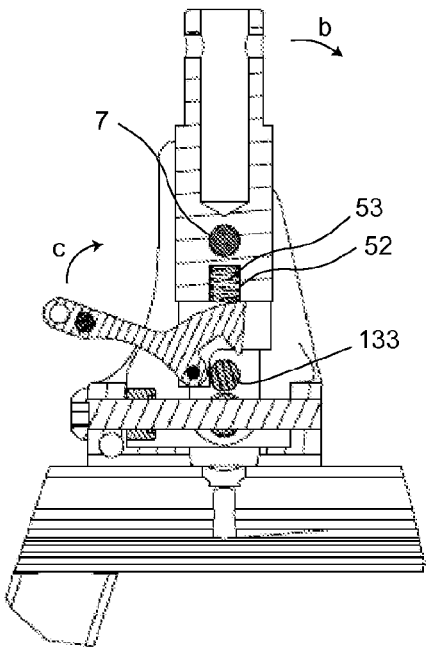
FIG. 10*b* is a view similar to FIG. 10*a*, but in a second position of the locking/unlocking element, the backrest frame being in its released position.

In the embodiments shown in FIGS. 5*a*, 6 and 7*a*, the locking/unlocking element 14 comprises an upper part 14*a* and a lower part 14*b* integral therewith, said locking/unlocking element having a substantially L-shape form. As shown in FIG. 5*c*, the lower part 14*b* is defined by a curved shape upper side 148 linked to the lower side 149 thereof by an obliquely extended surface 143, defining a bevelled cam surface as explained in greater detail in the following description. The lower side 149 is provided with a laterally oriented groove 141 adapted to receive the upper part 133 of the abutment element 13 in the locked inclined position of the backrest frame 5, as illustrated in FIG. 7*a*. The lower part 14*b* is at least partially received inside a longitudinal housing 56 provided in the tubular element 5*a*, said housing 56 being defined by left and right parallel flanges 57 and 58 protruding in a vertical direction from a bottom surface 51 defining the lower end of the tubular element 5*a*. So as to pivotally connect the locking/unlocking element 14 to the lower end portion 5*c* of the tubular element 5*a*, the lower part 14*b* of the locking/unlocking element 14 is provided with a laterally oriented through-hole 147 adapted to receive a pin 142 received inside and fixedly connected to laterally oriented through-holes provided in the left and right flanges 57 and 58 respectively. The upper part 14*a* extends at least partially outside of the support 11 so that the user can handle it. In particular, said upper part 14*a* defines a lever arm adapted to be actuated by a user so as to pivot the locking/unlocking element 14 relative to the tubular element 5*a* between a first position in which the upper part 14*a* abuts against the lower end 51 of the tubular element 5*a*, as illustrated in FIG. 10*a*, and a second position in which the lower part 14*b* abuts against said lower end 51, as illustrated in FIG. 10*b*. The locking/unlocking element 14 is advantageously urged into its first position by biasing means 53. In the embodiment shown, said biasing means consists in a compression spring 53, whose the upper end is received inside an axially oriented recessed hole 52 emerging from the lower end 51 of the tubular element 5*a* and abuts against the bottom 54 of said recessed hole 52 and whose the lower end abuts against the upper side 148 of the lower part 14*b* of the locking/unlocking element 14. Thus, when the locking/unlocking element 14 moves from its first position to its second position, the spring 53 is compressed inside the recessed hole 52. The locking/unlocking element 14 comprises also one pin 144 laterally protruding from both side faces of the upper part 14*a*. Accordingly, a laterally oriented through-hole 145 is advantageously provided in said upper part 14*a* so as to receive said pin 144. As shown in FIG. 2*d*, the left end 144*a*, respectively the right end 144*b*, of said pin 144 is adapted to be received inside a cavity or trough 111*i*, respectively 112*i*, provided in the upper portion of the left part 111, respectively the right part 112, of the support 11 when the backrest frame 5 in its folded position shown in FIG. 2*c* and when the locking/unlocking element 14 is in its first position. In this locked folded position, the tubular element 5*a* is prevented to pivot relative to the support 11 in the clockwise direction but may slightly pivot relative to the support 11 in the anticlockwise direction until the pin 144 abuts against a vertical portion 111*j*, respectively 112*j*, of the cavity or trough 111*i*, respectively 112*i*. Thus, to unlock the backrest frame 5 from this locked folded position, the user may move the locking/unlocking element 14 from its first position to its second position when the pin 144 does not abut against the vertical portions 111*j* and 112*j*. Such a movement may advantageously be done by pulling a cord or a string that is fixedly connected at one end to the locking/unlocking element 14 pivotally connected to the tubular element 5*a* that is pivotally connected to the left side component 1*a* of the wheelchair frame 1 and at the other end to the locking/unlocking element 14 pivotally connected to the tubular element 5*a* that is pivotally connected to the right side component 1*b* of the wheelchair frame 1. A laterally oriented through-hole 146 may advantageously be provided in the upper part 14*a* of the locking/unlocking element 14 so as to receive said cord or string.

In a further embodiment of the locking/unlocking means 12, illustrated in FIG. 7*b*, the pivoting locking/unlocking element 14 of FIG. 7*a* is replaced by a locking/unlocking element 14' fixedly connected to the lower end portion 5*c* of the tubular element 5*a*. Accordingly, the compression spring 53 is removed from the recessed hole 52 provided at the lower end 51 of the tubular element 5*a*. The locking/unlocking element 14' is advantageously configured as a substantially parallelepiped piece which is completely received inside the housing 56 of the tubular element 5*a* and abuts against the lower end 51 thereof. The lower side of said parallelepiped piece 14' is provided with a groove 141' adapted to receive the upper part 133 of the abutment element 13 in the locked inclined position of the backrest frame 5. Thus, a stepless adjustment of the angle between the backrest and the seat of the wheelchair can be done by simply moving the abutment element 13 in the longitudinal direction along the threaded rod 151, as already explained in the preceding paragraphs with respect to the locking/unlocking element 14. However, in this embodiment, the backrest frame 5 may only be released from said locked inclined position by dismantling said locking/unlocking element 14' from the lower end portion 5*c* of the tubular element 5.

FIG. 10*b* illustrates an intermediate position of the locking/unlocking element 14 and of the tubular element 5*a* during the movement of the backrest frame from its locked inclined position, illustrated in FIG. 10*a*, to its locked folded position.

The intermediate position illustrated in FIG. 10*b* results of the pivoting movement of the locking/unlocking element 14 in the anticlockwise direction around the pivot axis 142 from its first position, as indicated in (a) in FIG. 10*a*. During this movement, the locking/unlocking element 14 compresses the spring 53 inside the recessed hole 52. This movement permits to at least partially position the upper part 133 of the abutment element 13 outside of the groove 141 of the locking/unlocking element 14, thus unlocking the backrest frame from its locked inclined position. Thereafter, so as to position the backrest frame in its locked folded position, the tubular element 5*a* will be pivotally moved in the clockwise direction around the pivot axis 7, as indicated in (b) in FIG. 10*b*, till the plane P1 and the plane P2 be substantially parallel and the locking/unlocking element 14 will return to its first position, as indicated in (c) in FIG. 10*b*.

Figure 10C:
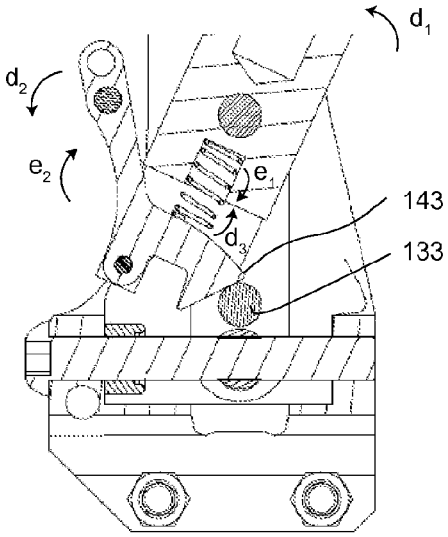
FIG. 10*c* is a view similar to FIG. 10*a*, but the backrest frame being in an intermediate position between its folded position and its erected position.

FIG. 10*c* illustrates an intermediate position of the locking/unlocking element 14 and of the tubular element 5*a* during the movement of the backrest frame from to its locked folded position to its locked inclined position.

In this intermediate position, the locking/unlocking element 14 is in its first position and the tubular element 5*a* is in a partially locked inclined position in which it can pivot in the clockwise direction but not in the anticlockwise direction due to the fact that the bevelled cam surface 143 of the locking/unlocking element 14 abuts against the upper part 133 of the abutment element 13. To move the backrest frame from said partially locked inclined position to its locked inclined position, the user must pivot the tubular element 5*a* under constraint in the anticlockwise direction, as indicated in (d1) in FIG. 10*c*. During this operation, the bevelled cam surface 143 interacts with the upper part 133 so as to produce a pivoting movement of the locking/unlocking element 14 around the pivot axis 142 in the anticlockwise direction, as indicated in (d2) in FIG. 10*c*, and a compression of the spring 53 inside the recessed hole 52, as indicated in (d3) in FIG. 10*c*. Thus, the tubular element 5*a* can pivot in the anticlockwise direction till the contact between the bevelled cam surface 143 and the upper part 133 ceases. This happens when the groove 141 is substantially aligned with the upper part 133. Thereafter, the spring 53 forces the locking/unlocking element 14, as indicated in (e1) in FIG. 10*c*, to pivot in the clockwise direction till it abuts against the lower end of the tubular element 5*a*, as indicated in (e2) in FIG. 10*c*, thus positioning the upper part 133 inside the groove 141.

The above detailed description with reference to the drawings illustrates rather than limit the invention. There are numerous alternatives, which fall within the scope of the appended claims.

The invention claimed is:

1. A wheelchair comprising a wheelchair frame resting on wheels and supporting a seat, and a backrest frame supporting a backrest, said backrest frame being pivotally connected to said wheelchair frame and comprising two lateral tubular elements, wherein each tubular element comprises an upper end portion provided with a handle and a lower end portion pivotally mounted on an axis supported on a support fixedly connected to the wheelchair frame, wherein locking/unlocking means are provided for preventing the lower end portion of each one of said tubular elements to pivot relative to the corresponding support in a locked inclined position of the backrest frame, wherein the locking/unlocking means comprise at least one abutment element against which abuts a locking/unlocking element connected to the lower end portion of one of said tubular elements of the backrest frame in the locked inclined position, said abutment element being steplessly movable in a longitudinal direction relative to the support supporting the pivot axis of said lower end portion under the action of driving means supported by said support, thus permitting a stepless adjustment of the angle between a plane defined by the backrest and a plane defined by the seat in said locked inclined position, wherein said driving means comprise a threaded rod to which is threadedly connected the abutment element, the position of said abutment element being adjusted along a longitudinal direction by screwing or unscrewing said threaded rod via a control member, said threaded rod being secured on the support through a self-locking type nut, thus prohibiting any loosening of said threaded rod, and wherein the abutment element is configured to be at least partially received inside a laterally oriented groove of the locking/unlocking element in the locked inclined position of the backrest frame so as to prevent the locking/unlocking element together with the tubular element to pivot relative to the corresponding support.

2. The wheelchair of claim 1, wherein the control member is the head of a screw, the threaded rod corresponding to the shank of said screw.

3. The wheelchair of claim 1, wherein the control member is a knob fixedly connected at one end of said threaded rod.

4. The wheelchair of claim 1, wherein the locking/unlocking element is fixedly connected to the tubular element.

5. The wheelchair of claim 1, wherein the locking/unlocking element is pivotally connected to the tubular element between at least one first position, in which the abutment element is at least partially received inside the groove of the locking/unlocking element, thus maintaining the backrest frame in its locked inclined position, and at least one second position, in which the abutment element is out of engagement with said groove, thus moving the backrest frame from its locked inclined position to a released position, in which the tubular element can freely pivot relative to the corresponding support.

6. The wheelchair of claim 5, wherein the locking/unlocking element is urged into the first position by biasing means.

7. The wheelchair of claim 6, wherein the biasing means comprise a compression spring whose the upper end is received inside an axially oriented recessed hole provided at the lower end of the tubular element and abuts against the bottom of said recessed hole and whose the lower end abuts against an upper side of the locking/unlocking element, the groove of said locking/unlocking element being provided at a lower side of the locking/unlocking element and the pivot axis between the locking/unlocking element and the tubular element being positioned so that the spring is compressed when the locking/unlocking element moves from the first position to the second position.

8. The wheelchair of claim 7, wherein the locking/unlocking element comprises a bevelled cam surface obliquely extended between the upper side and the lower side thereof, said cam surface being configured to interact with the abutment element when the backrest frame is moved under constraint from the released position to the locked inclined position so that the spring is compressed by said locking/unlocking element, thus facilitating the movement of the backrest frame from the released position to the locked inclined position.

9. The wheelchair of claim 8, wherein the abutment element comprises a lower part and an upper part, said lower part being provided with a longitudinal threaded through-hole adapted to receive the threaded rod and said upper part having a substantially cylindrical form and extending in a lateral direction so that the cam surface interact with said upper part so that the spring is compressed by the locking/unlocking element when the backrest frame moves under constraint from its released position to its locked inclined position.

10. The wheelchair of claim 9, wherein the lower part and the upper part of the abutment element are integral in one single piece.

11. The wheelchair of claim 9, wherein the lower part and the upper part of the abutment element are connected to two parallel plates, an upper end of each of said plates being pivotally connected to the support to which is pivotally connected the tubular element.

12. The wheelchair of claim 11, wherein the pivot axis between the plates and the support corresponds to the pivot axis between the tubular element and the support.

13. The wheelchair of claim 5, wherein the locking/unlocking element comprises an upper part and a lower part, said upper part defining a lever arm adapted to be actuated by a user so as to pivot the locking/unlocking element relative to the tubular element and said lower part supporting the pivot axis between said locking/unlocking element and said tubular element and defining the groove inside which is at least partially received the abutment element in the first position of the locking/unlocking element.

14. The wheelchair of claim 13, wherein the locking/unlocking element comprises at least one pin laterally protruding from at least one side face of the upper part of said locking/unlocking element, said pin being adapted to be received inside at least one cavity or trough provided in the support to which is pivotally connected the tubular element when the backrest frame is in a locked folded position, in which the plane defined by the backrest is substantially parallel to the plane defined by the seat and in which said tubular element is prevented to pivot relative to said support.

15. The wheelchair of claim 1, wherein a longitudinal slot is provided in a lateral face of the support to which is pivotally connected the tubular element, said slot being substantially aligned with the threaded rod so that the position of the abutment element along said threaded rod can be seen.

16. The wheelchair of claim 15, wherein said lateral face is provided with a scale so that the angle between the plane defined by the backrest and the plane defined by the seat in the locked inclined position of the backrest frame can be evaluated by reading the graduation of the scale which is aligned with the position of the abutment element.

17. A wheelchair comprising a wheelchair frame resting on wheels and supporting a seat, and a backrest frame supporting a backrest, said backrest frame being pivotally connected to said wheelchair frame and comprising two lateral tubular elements, wherein each tubular element comprises an upper end portion provided with a handle and a lower end portion pivotally mounted on an axis supported on a support fixedly connected to the wheelchair frame, wherein locking/unlocking means are provided for preventing the lower end portion of each one of said tubular elements to pivot relative to the corresponding support in a locked inclined position of the backrest frame, wherein the locking/unlocking means comprise at least one abutment element against which abuts a locking/unlocking element connected to the lower end portion of one of said tubular elements of the backrest frame in the locked inclined position, said abutment element being steplessly movable in a longitudinal direction relative to the support supporting the pivot axis of said lower end portion under the action of driving means supported by said support, thus permitting a stepless adjustment of the angle between a plane defined by the backrest and a plane defined by the seat in said locked inclined position, wherein the abutment element is configured to be at least partially received inside a laterally oriented groove of the locking/unlocking element in the locked inclined position of the backrest frame so as to prevent the locking/unlocking element together with the tubular element to pivot relative to the corresponding support, wherein the locking/unlocking element is pivotally connected to the tubular element between at least one first position, in which the abutment element is at least partially received inside the groove of the locking/unlocking element, thus maintaining the backrest frame in its locked inclined position, and at least one second position, in which the abutment element is out of engagement with said groove, thus moving the backrest frame from its locked inclined position to a released position, in which the tubular element can freely pivot relative to the corresponding support, wherein the locking/unlocking element is urged into the first position by biasing means, and wherein the biasing means comprise a compression spring whose the upper end is received inside an axially oriented recessed hole provided at the lower end of the tubular element and abuts against the bottom of said recessed hole and whose the lower end abuts against an upper side of the locking/unlocking element, the groove of said locking/unlocking element being provided at a lower side of the locking/unlocking element and the pivot axis between the locking/unlocking element and the tubular element being positioned so that the spring is compressed when the locking/unlocking element moves from the first position to the second position.

18. A wheelchair comprising a wheelchair frame resting on wheels and supporting a seat, and a backrest frame supporting a backrest, said backrest frame being pivotally connected to said wheelchair frame and comprising two lateral tubular elements, wherein each tubular element comprises an upper end portion provided with a handle and a lower end portion pivotally mounted on an axis supported on a support fixedly connected to the wheelchair frame, wherein locking/unlocking means are provided for preventing the lower end portion of each one of said tubular elements to pivot relative to the corresponding support in a locked inclined position of the backrest frame, wherein the locking/unlocking means comprise at least one abutment element against which abuts a locking/unlocking element connected to the lower end portion of one of said tubular elements of the backrest frame in the locked inclined position, said abutment element being steplessly movable in a longitudinal direction relative to the support supporting the pivot axis of said lower end portion under the action of driving means supported by said support, thus permitting a stepless adjustment of the angle between a plane defined by the backrest and a plane defined by the seat in said locked inclined position, wherein the abutment element is configured to be at least partially received inside a laterally oriented groove of the locking/unlocking element in the locked inclined position of the backrest frame so as to prevent the locking/unlocking element together with the tubular element to pivot relative to the corresponding support, wherein the locking/unlocking element is pivotally connected to the tubular element between at least one first position, in which the abutment element is at least partially received inside the groove of the locking/unlocking element, thus maintaining the backrest frame in its locked inclined position, and at least one second position, in which the abutment element is out of engagement with said groove, thus moving the backrest frame from its locked inclined position to a released position, in which the tubular element can freely pivot relative to the corresponding support, and wherein the locking/unlocking element comprises an upper part and a lower part, said upper part defining a lever arm adapted to be actuated by a user so as to pivot the locking/unlocking element relative to the tubular element and said lower part supporting the pivot axis between said locking/unlocking element and said tubular element and defining the groove inside which is at least partially received the abutment element in the first position of the locking/unlocking element.

* * * * *